US008250797B2

(12) United States Patent
Padgett et al.

(10) Patent No.: US 8,250,797 B2
(45) Date of Patent: Aug. 28, 2012

(54) TWO-PIECE WRISTBAND WITH SLIDABLE EXTENSION FOR USER-SELECTABLE SIZING

(75) Inventors: John M. Padgett, Clermont, FL (US); Michael G. Jungen, Orlando, FL (US); John David Worrall, Clermont, FL (US); Maximillian Philip Burton, San Francisco, CA (US); Carson Lau, San Francisco, CA (US); Adam D. Leonards, El Cerrito, CA (US)

(73) Assignee: Disney Enterprises, LLC, Burbank, CA (US)

( * ) Notice: Subject to any disclaimer, the term of this patent is extended or adjusted under 35 U.S.C. 154(b) by 80 days.

(21) Appl. No.: 12/715,054

(22) Filed: Mar. 1, 2010

(65) Prior Publication Data

US 2011/0209375 A1 Sep. 1, 2011

(51) Int. Cl.
*A44C 5/00* (2006.01)

(52) U.S. Cl. ..... 40/633; 63/3.2

(58) Field of Classification Search ..... 40/633; 224/164, 175, 179; 2/321, 195.2; 63/3.1, 63/3.2; 24/265 WS; 368/282
See application file for complete search history.

(56) References Cited

U.S. PATENT DOCUMENTS 1,543,399 A * 6/1925 Smith ..... 224/176
2,641,074 A * 6/1953 Richmond ..... 40/633
4,178,751 A * 12/1979 Liautaud ..... 368/281
4,615,185 A * 10/1986 Bollinger ..... 63/1.13
4,742,503 A 5/1988 Braun et al.
4,906,025 A 3/1990 Schreindl
5,065,376 A 11/1991 Choulat
5,416,953 A 5/1995 Hui
7,041,032 B1 5/2006 Calvano (Continued)

FOREIGN PATENT DOCUMENTS

GB 2465850 A * 6/2010

OTHER PUBLICATIONS

Toyota RFID Wristwatch, core77, http://www.core77.com/blog/object_culture/toyota_rfid_wristwatch_2986.asp, Oct. 4, 2005.*

(Continued)

*Primary Examiner* — Gary Hoge
(74) *Attorney, Agent, or Firm* — Marsh Fischmann & Breyfogle, LLP; Kent A. Lembke

(57) ABSTRACT

A wearable band with an adjustable size or length. The band includes a first band element with a body extending from a first to a second end, and the body may include a recessed surface or other receiving portion. The wearable band further includes a second band element or slidable extension with a body extending from a first to a second end. To provide user-selectable sizing, the second band element may be selectively positioned by sliding within the receiving portion of the first band element body so as to extend inward a desired engagement depth from the second end of the first band element body. A portion of the second band element body extends outward from the opening of first band element body such that this extending portion and a length of the first band element body combine to define an overall length of the wearable band assembly.

10 Claims, 5 Drawing Sheets

U.S. PATENT DOCUMENTS

| | | | | |
|---|---|---|---|---|
| 7,348,888 | B2 | 3/2008 | Girvin | |
| 7,454,855 | B2 * | 11/2008 | Kotik et al. | 40/633 |
| 7,481,370 | B2 | 1/2009 | Davis | |
| 2005/0108912 | A1 | 5/2005 | Bekker | |
| 2006/0144881 | A1 * | 7/2006 | Bonadei | 224/164 |
| 2006/0230661 | A1 * | 10/2006 | Bekker | 40/633 |
| 2008/0216372 | A1 * | 9/2008 | Lee | 40/633 |
| 2009/0096614 | A1 | 4/2009 | Singleton et al. | |

OTHER PUBLICATIONS

Wristloks, http://www.adsources.com/CATALOG/wristlocks.htm, retrieved on Dec. 14, 2009, Wristlocks Wristbands.

Synometrix, http://www.synometrix.com/china_taiwan_rfid_bracelets.shtml, RFID Wristbands & RFID Bracelets & FRID Bracelet Manufacturers China Asia, retrieved on Dec. 14, 2009.

* cited by examiner

TWO-PIECE WRISTBAND WITH SLIDABLE EXTENSION FOR USER-SELECTABLE SIZING

BACKGROUND

1. Field of the Description

The present description relates, in general, to wearable bands such as wristbands that are adjustable in size, and, more particularly, to wearable band assemblies that include a multi-sizing mechanism provided by a two-piece band design, e.g., including a slidable sizing band element (or slider extension band or, more simply a slider or an extension) that mates with a base (or identification) band element, that allows the band to be sized in a tool-less manner by a user or wearer.

2. Relevant Background

Bands such as wristbands are worn in numerous settings. For example, watches have typically been worn on a wrist through the use of a wristband. In hospitals, patients often are provided an identification bracelet, strap, or band that they wear on their wrist. An amusement or theme park may provide a visitor or guest with a wristband that includes identification information or technology (e.g., a readable bar code, a radio frequency identification (RFID) transceiver or module, or the like) that identifies the visitor and allows the visitor to access the park's facilities. Often, bands are worn as fashion accessories or to allow the wearer to make a statement (e.g., to support a cause such as medical research, a political candidate, a sports team, or the like). It is likely that the demand for wearable bands such as wristbands will continue to grow in the coming years.

One ongoing challenge for the makers of wristbands and other wearable bands is providing proper sizing for the end users. For example, most multi-size wristwatches include a first band portion that is attached at a first end to the timepiece and at a second end may have a number of spaced apart holes. A second band portion is attached at its first end to the timepiece and at its second end may contain a buckle-style clasp mechanism for mating with the holes of the first band portion. A person uses the clasp mechanism to both size the band about their wrist and to also lock the timepiece to their wrist. The wristwatches are multi-size in that the spaced apart holes allow the same wristwatch to be worn by a set of people whose wrists have a size that falls within a predefined range (e.g., a minimum and maximum sized wrist diameter defined by the first and last hole on the band), and the wristwatches of this design would be considered "one-piece" in that all band portions and the timepiece are connected together such that a tool is typically required to disassemble the portions of the wristwatch.

However, the wristwatches are not truly multi-sized in that people over large ranges of wrist sizes cannot wear the same wristwatch. Specifically, people outside a predefined range would not be able to wear the wristwatch, and the wristwatch manufacturer either simply loses these sales or may provide additional wristwatches that have different size ranges to suit these other buyers. Unfortunately, this requires added inventory that may or may not ever be sold by the seller causing them a loss in profits. Some efforts have been made to provide band designs that allow the band to be sized for a particular person, but these designs typically require specialized tools to adjust the band and may be more expensive to manufacture. In other cases, a band specifically selected for a user to match their wrist size may be attached to the timepiece, but, again, this typically requires a special tool for attachment of the band to the timepiece, requires additional inventory to provide numerous band sizes, and may require the buyer to have the watch sized by a trained technician.

As another example of the use of wearable bands, RFID wristbands are commonly used in hospitals and entertainment venues to identify individual patients and guests. The wristband may include or provide a link to a variety of information such as the person's name, their room number, a seating location for a show, entitlements permitted in the hospital or venue, and so on. The wristband is often designed to be secured or locked onto the wrist of the person during their stay at the hospital or participation in an entertainment event and to be destroyed or cut to remove them from the wearer's wrist.

While these wristbands have been useful in identifying the patients and guests, their design has typically not effectively accommodated the wide range of users' wrist sizes, which has resulted in many users having very loose or too tight and uncomfortable fitting wristbands. Additionally, many wristband designs use either an adhesive closure that is peeled away from the wristband or a separate, one-time plastic snap closure. The adhesive closures sometimes do not provide the closing strength desired and once removed, cannot be worn again. The plastic snap closures provide greater closing strength but often are intentionally designed for one time use, which limits use of these bands on an ongoing or repeated basis. Further, the snap closures often do not support a large enough range of wrist sizes such that they are often too tight or cannot be worn comfortably or are too loose which may allow them to fall off.

Accordingly, there remains a need for a low cost, multi-sizing mechanism for RFID wristbands and other wearable bands or straps. The band designs preferably would have durable opening and closing features to allow reuse of the band (e.g., not just one-time use) and would support relatively inexpensive manufacture from a variety of available materials such as plastics, silicones, metals, leathers, cloths, and/or other materials used presently (and in the future) for wearable bands. Further, there is a need for such a multi-sizing mechanism to be more fully adjustable to the wearer's wrist size, to provide a secure fastening mechanism that during regular wear can be fastened and unfastened by the wearer with ease, and to provide an aesthetic appearance that accommodates different wrist sizes within a large audience or wearer demographic.

SUMMARY

To address the above and other problems with wearable bands such as identification bands, a wearable band design is provided that allows a wearer to easily adjust the size of the band to suit the size of their wrist (or other body part such as the ankle or neck). The multi-sizing mechanism or functionality is provided by a two-piece band design including a base or identification band element and a sizing band element or extension/slider band. The sizing band element may be contained or received within a fixed groove or glide path (e.g., recessed surface) in the body of the base band element. The sizing band element may be slid or moved into a user-selected position within the glide path and then coupled or interconnected to the body of the base band element.

In this manner, the length of the wearable band is defined by the length of the base band element body and the portion of the sizing band element that extends outward from the glide path or recessed surface of the base band element body. The sizing band element (or extension or slider) may include a series of holes running linearly along its body, and the body of the base band element may include one or more studs or posts extending outward within the recessed surface or glide path to allow selective interconnection of the sizing band element to the base band element body. This also sizes the wearable band by forming a single band, which may then be attached to a wearer's wrist such as by pressing one or more posts or studs extending from the body (such as near its end) of the sizing band element through one or more corresponding holes on an end of the base band element body.

It was recognized that prior techniques of providing multi-size wristbands and similar products seemed to either require large inventories or provided a disposable wristband that provided no ongoing revenue source (or source of additional product sales). The wearable band assemblies described herein provide a product platform in that they typically include a base portion (e.g., a band element with an RFID or other information technology component) and an interchangeable extending or sizing portion (e.g., a slidable extension or sizing band element) that may be used with the base band element to size the wearable band assembly by the user. The slidable sizing band element may readily be attached and detached from the base portion, which may include a recessed surface to receive the sizing band element to provide a flush interface with the wearer's skin.

In this manner, the wristband assembly permits interchangeability with a wide range of wearable styles of merchandise product offerings as the sizing band element may be sold or distributed separately from the base portion so as to allow a user/wearer to later purchase differing band elements to personalize or modify their wristband or wearable band assembly. The base or identification band element, though, may be provided in a single (or limited number) of designs to simplify its design and reduce cost of its manufacture and distribution (or inventory costs as only one to several choices may be provided).

In some cases, a band assembly is provided that allows an RFID or other identification module to be worn by end-user's that may have a wrist size falling within a relatively large range (or within two, three, or more wrist size ranges). The band assembly may be considered a two-piece design in that it includes: (a) a base or ID band element with a body that includes a user identification member such as an RFID tag or module at one end and a recessed surface or glide path on an inner side of the body (e.g., on the side that is adjacent a user's wrist); and (b) a sizing or extending band element with a body that includes holes or other devices for attaching to the base or ID band element (e.g., for mating with studs/posts provided in the recessed surface or glide path once the sizing band element is slid into a desired position to define an overall band assembly length). The two interlocking bands cover or are useful with a number of defined wristband size ranges. In some embodiments, a smallest wrist size range is covered by use of the base band element as a one-piece band with it being closed upon itself (e.g., one end with holes is coupled with the posts/studs in the recessed surface).

More particularly, a wearable band is provided with an adjustable size or length. The band includes a first band element (or base band) with a body extending from a first to a second end. The first band element body includes a receiving portion with an opening at the second end, and, in one embodiment, the receiving portion includes a recessed surface provided on one side or one surface of the body (e.g., the side that would be placed next to the wearer's skin or wrist). The wearable band further includes a second band element (or slidable extension) with a body extending from a first to a second end.

To provide sizing, the second band element (or sizing band element) may be selectively positioned (such as by sliding) within the receiving portion of the first band element body so as to extend inward an engagement depth from the second end of the first band element body. A portion of the second band element body extends outward from the opening of the first band element body such that this extending portion and a length of the first band element body combine to define an overall length of the wearable band assembly. The overall length is, hence, adjustable since the engagement depth may be modified by a wearer by moving or sliding the second band element body within the receiving portion.

To couple the two band elements together, the receiving portion may include one, two, or more posts/studs extending outward from the first band element body. The second band element body may include one, two, or more holes or recessed surfaces for receiving the posts/studs when the second band element body is placed in the receiving portion (at the engagement depth). The receiving portion may include a recessed surface in the first band element body extending from its second end. In such cases, the second band element body may be planar with a first width and first thickness, and the recessed surface may have a second width as measured between two sidewalls extending into the first band element body, with the second width being equal to or greater than the first width and with the sidewalls having a height equal to or greater than the first thickness (e.g., such that the body of the first band element (or a portion thereof) may be fully received within the recessed surface). The first band element body may include (such as at or near the second end or head of the body) a user identification member storing information corresponding to the wearer of the band, and the user ID member may be provided as an RFID tag or the like.

DETAILED DESCRIPTION OF THE PREFERRED EMBODIMENTS

The following description is generally directed toward a wearable band such as a wristband that may be readily configured to one of two or more overall lengths or sizes by changing the mounting or interconnecting point of one band element relative to the other. More specifically, the wearable band includes a base band element and a sizing band element (or extension) that may be slid within a recessed surface or glide path provided in the base band element body to change or set the overall length of the wearable band. Once slidably positioned, the sizing band element is coupled to the base band element body (e.g., by providing posts/studs on or in the recessed surface and holes in the sizing band element body). In other cases, the extension or sizing band element may simply be removed (or not used), and the base band element may be used by itself as a band (e.g., for people or children with relatively small wrist sizes).

FIGS. 1-6 illustrate several embodiments of such a wearable band, but, prior to describing these band embodiments, it may be useful to more generally describe exemplary wearable bands (which may also be called wristbands herein for simplicity of explanation without being limited to use on a wrist) and advantages of such bands when compared with existing bands or straps. Additionally, the following description highlights use of the bands as RFID wristbands, but it will be understood based on the description that the bands can readily be used with nearly any identification technology (such as barcodes or the like) as well as for bands without identification technologies/readable information. For example, the bands may be used with timepieces/watches or as products worn for fashion or other reasons.

Generally, the wearable bands described herein are designed to address or solve the multi-sizing and fastening mechanism problem that faces makers of wrist and other bands. The bands are easy for end users to assemble or configure into a particular size and allow interchanging of sizing band elements or even base band elements to personalize the bands. The bands are also adapted to make manufacture relatively inexpensive as its two-piece design provides a base band component or element (e.g., a band piece (or half of a wristband) that contains the identification module such as RFID tag or module) and a sizing band element. The base band element and the band sizing component are coupled together and function together to provide a multi-size band that can be used by all or a large portion of the population. The supply chain is also simplified in this manner as one or several base designs may be offered to the consumers, who can optionally personalize their bands by purchasing personalized/customized portions of the band (e.g., replacing all or portions of the two-piece design).

Figure 2:
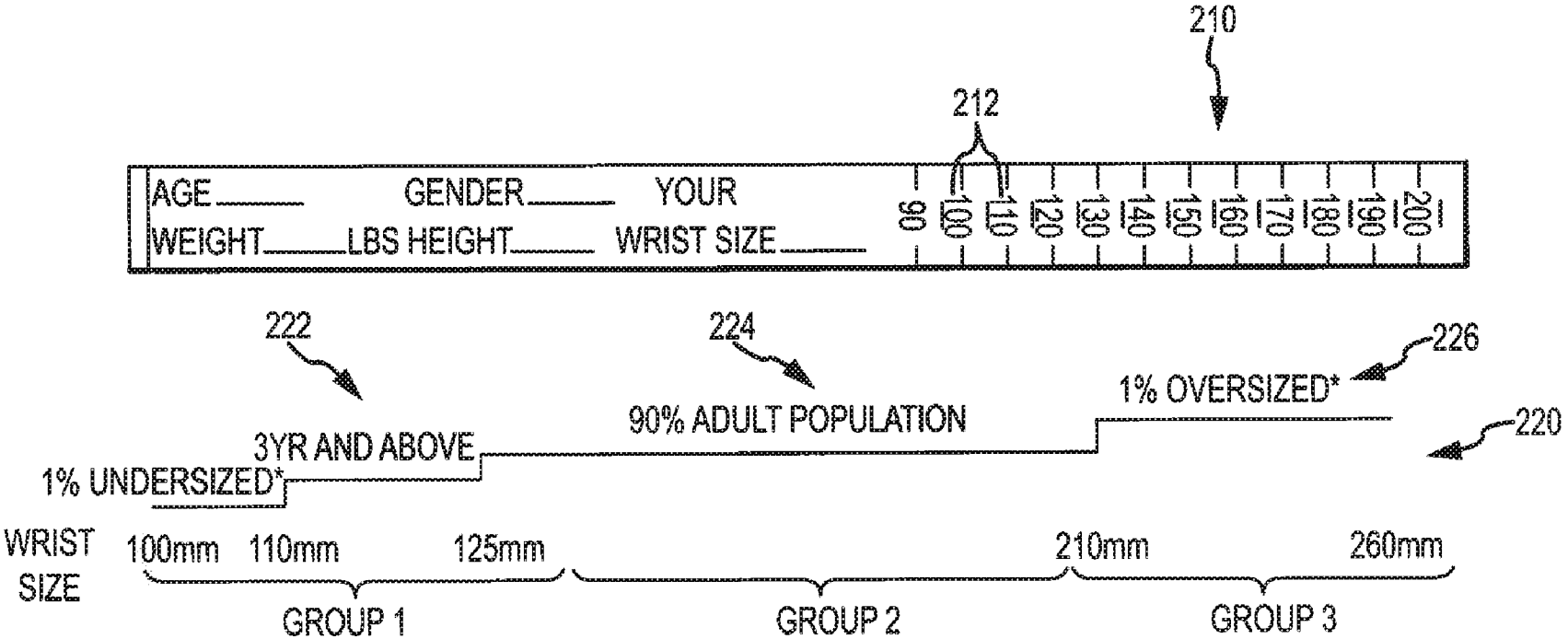
FIG. 2 illustrates a tape measure or tool that may be used by a purchaser/wearer of a band assembly to size their wrist and further illustrates a graph showing grouping of wrist sizes or ranges of wrist sizes to correspond to lengths/sizes of a band assembly (such as the assembly of FIG. 1) via inclusion or exclusion of sizing band element (or simply "sliding element" or "extension") or via its positioning relative to a base band element (e.g., positioning within the recessed surface or glide path of the base band element body)
Figure 3:
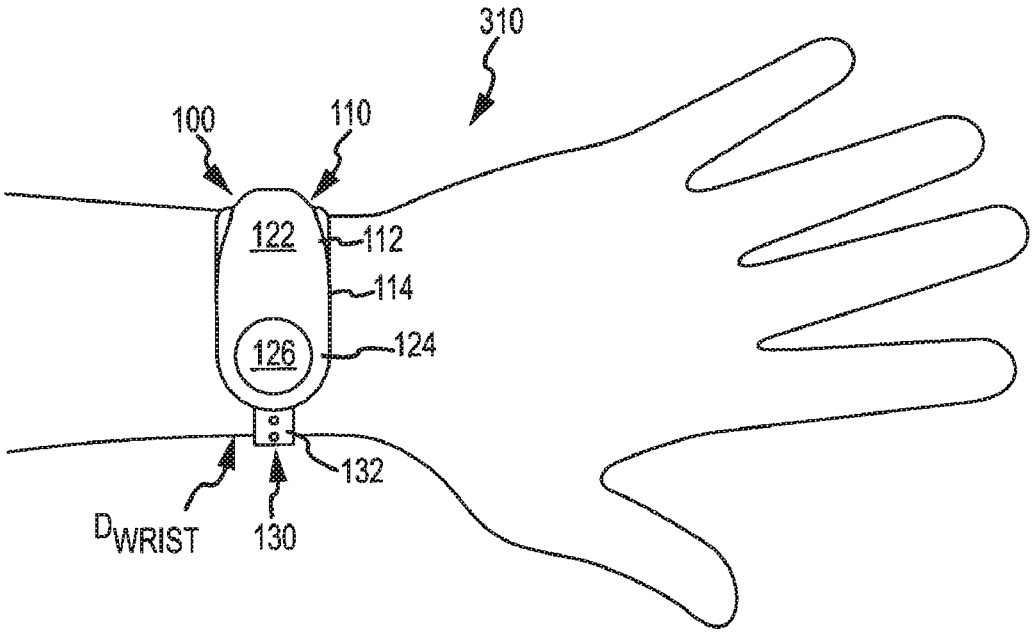
FIG. 3 illustrates a user or wearer wearing the band assembly shown in FIG. 1 with the sizing band element or extension included and positioned relative to the base band element so as to size the wrist assembly to the wrist of users/wearers.

In one example, an adjustable RFID wristband is provided that can be manufactured from a variety of modern day materials including plastics, rubbers, and silicones and even, in some cases, metals, leathers, cloths/textiles, and other materials. The wristband is fully adjustable by the wearer to suit their wrist size and also provides an aesthetic appearance. The wristband is also adapted to provide a secure wristband fastening mechanism that during regular wear can be fastened and unfastened by the wearer with exceptional ease (e.g., the band supports reuse rather than being a one-time product as was the case with many prior one-size-fits-all straps). This embodiment may be thought of as providing a band assembly made up of a two-piece band design including a base or identification band element and an extension or sizing band element. The extension may be left out of the wearable band assembly or included and slid to a particular engagement location relative to the base band element to allow the wristband to cover or be used with a defined wristband size range or wrist size range (see FIGS. 2 and 3 showing exemplary sizing groups and an assembled wristband worn on a user's wrist).

Prior to the band designs presented herein, many wristbands used either an adhesive closure that is peeled away from the wristband or a separate, one-time plastic snap closure. The adhesive closures sometimes did not provide a desired closing strength and once removed could not be worn again. The plastic snaps provided a greater closing strength but were also often designed for one-time use, did not fit the wearer comfortably, and/or were too loose. With regard to other band applications, a typical wristwatch incorporates a buckle-style watch clasp. Similar to shoe manufacturing, most wristwatches are designed with a particular style with that same style or product run having a variety of wristwatch bands in different sizes to accommodate the specific end users' wrist sizes. However, similar to shoe shopping, when an end user purchases a wristwatch they try on different sizes of wristwatches (or wristwatch bands) of the same style to determine which band fits them appropriately. Because of the variability of different end user wrist sizes, the watch retailer must keep a large inventory of different wristband sizes to accommodate their customers, which significantly increases inventory costs for the retailer that may be acceptable in some settings (such as for higher end band products such as certain wristwatches).

However, in many fashion and wearer ID settings (such as entertainment venues and the like), it is much more desirable to be able to provide a one-size-fits-all solution or band design that can be sized by the seller or the wearer to suit their wrist size rather than carrying numerous versions/sizes of the band. The described wearable bands provide a "one size fits all" design that provides a user-selectable (slidable) sizing among a number of sizes with the overall length of the two-piece wearable band assembly depending upon the chosen mounting or engagement point(s) between the base band element and sizing band element (or the bodies of these two elements). This band design allows a venue operator or provider of bands to maintain one or more common base band (e.g., the intelligence or ID portion of the two-piece band) inventory and one or more sizing band elements that together accommodate a wide range of wrist sizes (e.g., address the multi-sizing problem associated with serving large audience/customer bases).

Figure 1:
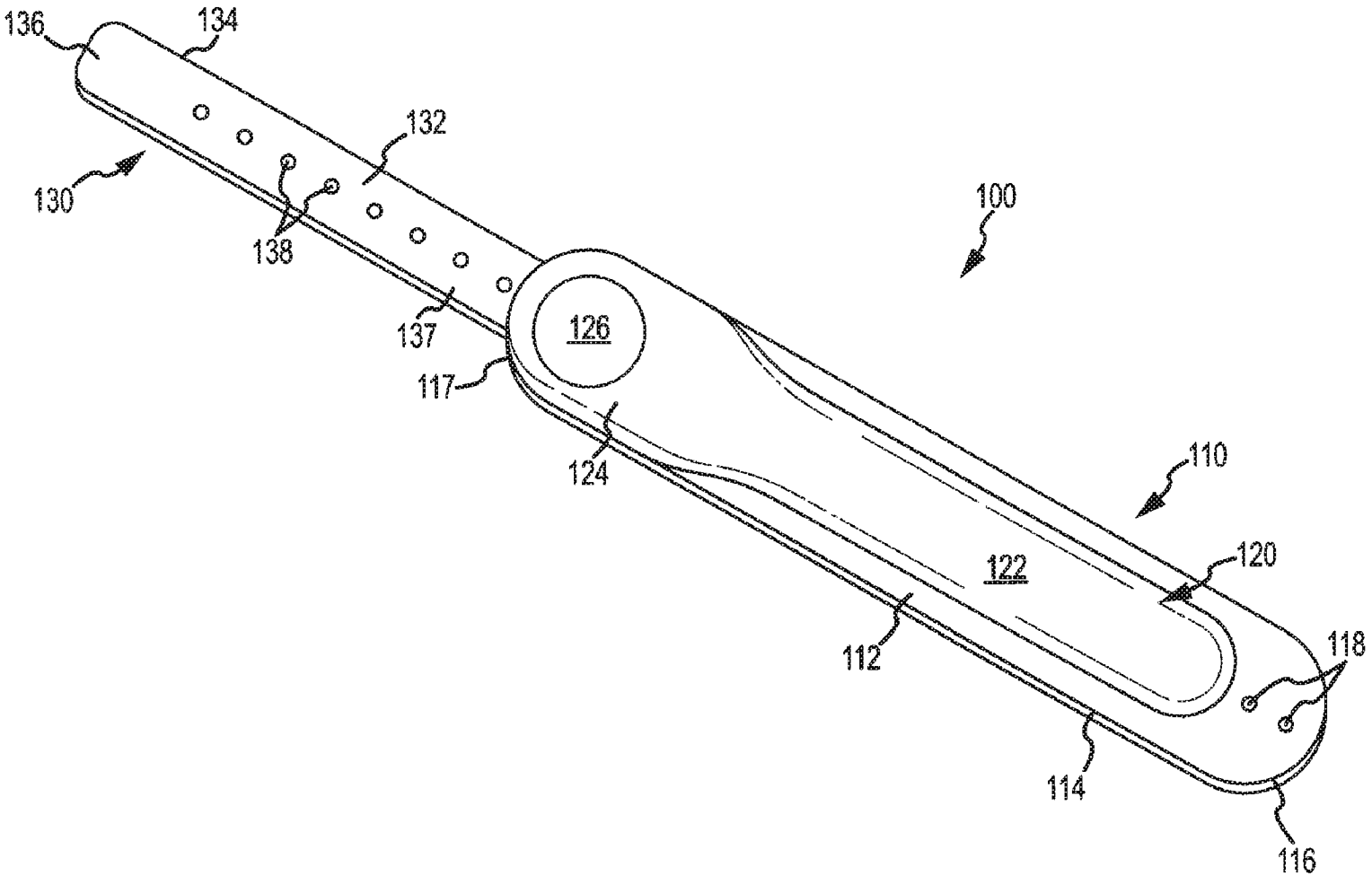
FIG. 1 is a top perspective view of a wearable band assembly of an embodiment of this description.
Figure 6:
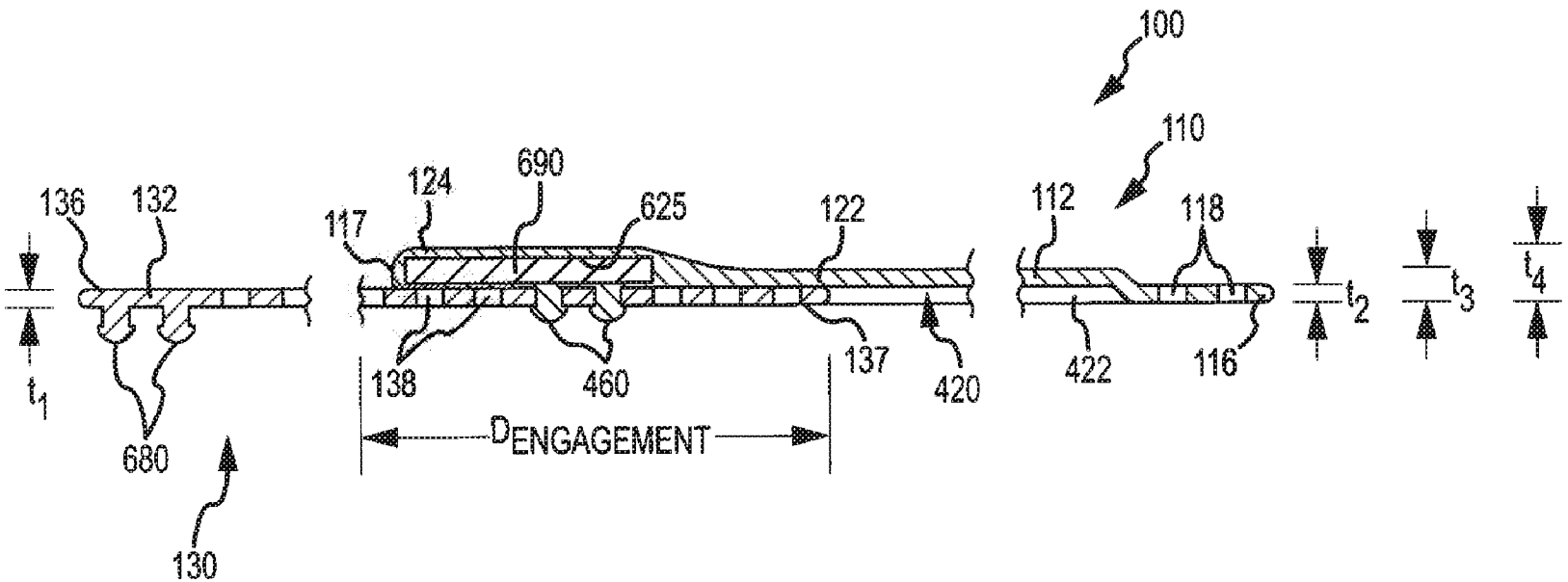
FIG. 6 illustrates a sectional view of the wearable band assembly taken along line 6-6 of FIG. 5.

FIG. 1 illustrates one embodiment of a wearable band assembly 100 that may be used to provide a single band product that can be worn or used by people (i.e., wearers or users) with wrist sizes that fall within one of two, three, or more predefined size groups. The band assembly 100 may be thought of as providing a two-piece band design that includes a base band or base band element 110 and a sizing band element (or slider element, extension, or the like) 130. The band assembly 100 may also include a clasp (not shown) for fastening the interconnected or coupled band element 110 and sizing band element 130 to a wearer's wrist or such fastening may be achieved as shown in FIGS. 3 and 6 via prongs or studs 680 provided in band element 130 mating with holes 118 in the base band element 110. In use, the wearer may simply position the sizing band element 130 relative to the base band element 110 and then interconnect the two elements 110, 130 to form the band assembly 100 as shown to size the band assembly 100 to fit their wrist.

The band element 110 may be thought of as the base or, in some cases, intelligence (or ID) band or component as this layer/element 110 is included in each configuration of the band assembly 100. The base band 110 has a body 112 that extends from a first end 116 to a second end 117. The shape of the body 112 is defined by an outer edge or sidewall 114 that extends about the periphery of the body 112, and, as shown, the body 112 may generally be rectangular with rounded or circular ends 116, 117. The body 112 may include a raised portion 120 with an elongated extension receiving portion 122 and a head or ID member 124 proximate to end 117. The receiving portion 122 is provided as explained below to provide a glide path or recessed surface in the body 112 for receiving a portion of the body 132 of the sizing band element 130 to size the band assembly 100. Hence, the receiving portion 122 generally may have a width that corresponds with the width of the body 132 of the extension 130 (e.g., a small amount greater in width to allow the body 132 to be received within the receiving portion 122).

The head/user identification member 124 of the body 112 may be a wider/larger portion of the raised portion 120 (e.g., match or proximate the width of the band body 112). The head 124 may be used to support decorative components 126 that may be nonfunctional jewelry or similar elements to personalize the band assembly 100 or may be functional elements such as timepieces or the like. The head or user ID member 124 may also be used to store/support one or more components providing a user identification technology such as a bar code device, an RFID module, or the like. Further, as discussed below, the body 112 also may include a portion of a coupling or interconnecting mechanism useful to connect or lock the body 112 to received or overlapping sizing band element 130. The body 112 also may include a number of holes 118 extending through its thickness at least at the end 116 such that posts/prongs (not shown in FIG. 1 but shown in FIG. 6) in end 136 of body 132 of extension 130 may be inserted into or mounted on a hole or holes 118 in end 116 to securely close the band assembly 100 upon a wrist when the band assembly 100 is configured/sized by positioning/sliding the extension 130 relative to the body 112 of base band element 130.

The band assembly 100 also includes a second piece in the form of a slider or sizing band element 130 that can be selectively coupled to the body 112 of the base band element 110 (such as within the receiving portion 122) as part of sizing or personalizing the band assembly 100. As shown, the sizing band element 130 includes a body 132 that extends from a first end 136 (which may include prongs/posts on an opposite side for clasping to holes 118 in end 116 of base band element body 112) to a second end 137. The shape of the body 132 is defined in part by the outer sidewall or edge 134 that extends about the periphery of the slider element or extension 130. The body 132 may be generally rectangular in its outer shape with rounded ends 136, 137 as defined by the outer edge or sidewall 134. Also, like the base band 110, the body 132 of the sizing assembly 130 may include a number of holes 138 extending generally from the first end 136 to the second end 137 to allow the body 132 to be coupled to the body 112 in a plurality of engagement or sizing locations in the receiving portion 122. In use, a wearer may slide the body 132 relative to the body 112 of the base band element 110 and then press the body 132 and the body 112 together to couple the two bodies 112, 132 together and size the assembly 100 for their wrist.

The bodies 112, 132 may be formed of the same or differing materials, and these materials may vary to implement the assembly 100. In some embodiments, the bodies 112, 132 are formed of a plastic, a rubber (e.g., a silicone or the like), or similar material that may be relatively rigid but still be comfortable to wear and also be flexible to facilitate coupling of the two band pieces 110, 130. The number of holes 138 may be varied widely to practice the assembly 100 as well as the spacing between adjacent ones of the holes 138. Generally, two to ten or more holes will be provided on the body 138 to allow the band assembly 100 to be sized for a range of wrist sizes in each of its two or more configurations by providing many engagement configurations (or relative positions of the body 132 relative to the body 112 or receiving portion 122). In other words, the band element 130 provides a range of sizes with its holes 138 that facilitate user-selectable interconnection (without tools) of the elements 110, 130 rather than only a single size with each configuration as would be the case if the band element 130 were permanently fixed in its location relative to the base band element 110.

FIG. 2 illustrates a tape measure 210 that may be used by a wearer to determine or measure their wrist size. The tape measure 210 includes markings 212 that indicate the measured size when the tape measure 210 is wrapped about the wrist and aligned with the end of the tape measure 210. As shown, in a human population, the smallest wrist size is typically about 90 millimeters (mm) while the largest wrist size is over 200 mm (such as about 260 mm or more). In one embodiment, the band assembly 100 may be provided or shipped with the tape measure 210, and the user/wearer may use the tape measure to determine their wrist size. This wrist size may then be used to determine whether to remove (or not use) the sizing band element 130 and just include the base band 110 in the assembly 100. If retained, the determined wrist size may be used to position or slide the extension 130 relative to the base band element 110 (such as by providing markings corresponding to wrist sizes on one or both of the bodies 112, 132). Alternatively, sizing of the assembly 100 may be done by trial and error by moving or sliding the extension 130 between engagement locations until a suitable fit is achieved for a user's wrist.

In this regard, graph 220 illustrates exemplary groups 222, 224, 226 that may be provided for a band assembly 100 for a typical human population. In this example, the band assembly 100 is a wristband and graph 220 represents differing wrist sizes for which it is desirable to provide a multi-sizing band assembly 100. As shown, a first group 222 that typically includes children and adults with smaller wrists is shown (e.g., wrists of about 100 to 130 mm or the like). In the band assembly 100, the base band 110 without use of the sizing band element or layer 130 may be configured to provide an assembly 100 with a length covering this first group. Holes 118 may be connected to post/studs in the receiving portion 120 of the body 112 to allow the assembly 100 to be worn by people with wrists falling into the first group 222 (e.g., less than about 130 mm in "diameter").

A second group 224 may be defined or selected to include a range of "average" teens and adults. For example, the second group 224 may range from about 130 mm (or some number smaller to provide overlap with group 222 such as 125 mm) to about 190 mm or the like, and the assembly 100 may be formed by connecting the sizing band element 130 to the base band element 110, with connection provided over a subset of the holes 138 (e.g., holes 138 proximate to the end 136 to a midpoint (or the like) of the body 132) to provide a medium sized assembly 100. In this manner, the combination of the base band 110 and sizing band element 130 may have a length that is chosen via a connection point between holes 138 and posts/studs in body 112 to allow the band assembly 100 with coupled bands 110, 130 to be worn by individuals having a wrist size between 130 and 190 mm (or other lower and upper bounds).

Finally, in this example, a third group 226 may be defined to include people with larger wrists such as wrists of 190 mm to 240 mm (or some other lower and upper bounds with the lower bound often being chosen to provide an overlap of the second and third groups 224, 226 such as 185 mm when the second group upper bound is 190 mm). A sizing band element 130 may be connected to the body 112 of the base band element 110 such that the assembly 100 now has a greater length such that this length as determined by which holes 138 are mated with body 112 (e.g., with holes 138 near end 137 to a midpoint of body 132 or the like) so as to allow people with wrist sizes falling in the third group 226 to wear the band assembly 100.

FIG. 3 illustrates the use of the band assembly 100 in one configuration 310 to provide a band with a length sized to the particular wrist and its diameter/size, $D_{wrist}$. In configuration 310, the band assembly 100 may be configured as shown in FIG. 1 to include the body 132 of sizing assembly 130 and base band element 110. The sizing band element 130 is coupled to the base band 110 via the holes 138 in body 132 when the body 132 is positioned within a recessed surface of receiving portion 122. The two pieces 110, 130 are also coupled at their other ends 116, 136 via holes 118 and posts/studs in end 136 although this is not shown or is hidden from view in FIG. 3.

The band assembly 100 may be sized to suit a first group of wrist sizes by removing the band element 130 or retaining the sizing band element 130 and slidably positioning it relative to the body 112 to suit a second and/or third groups of wrist sizes (a range(s) of larger wrist sizes). The larger the portion of the body 132 (or the greater the engaged length) that is slid into the receiving portion 122 the smaller the size or length of the band assembly 100. The band head or end 124 may include ID technology such as an RFID chip or module. In this manner in embodiments where the band assembly 100 provides user identification, the ID technology element within base band element 110 is included in the band assembly 100 in all configurations of the assembly 100. In some embodiments, the sizing band element 130 or even the base band element 110 may be exchanged or interchanged by the wearer for non-standard or original elements so as to customize the look to suit the wearer.

Figure 4:
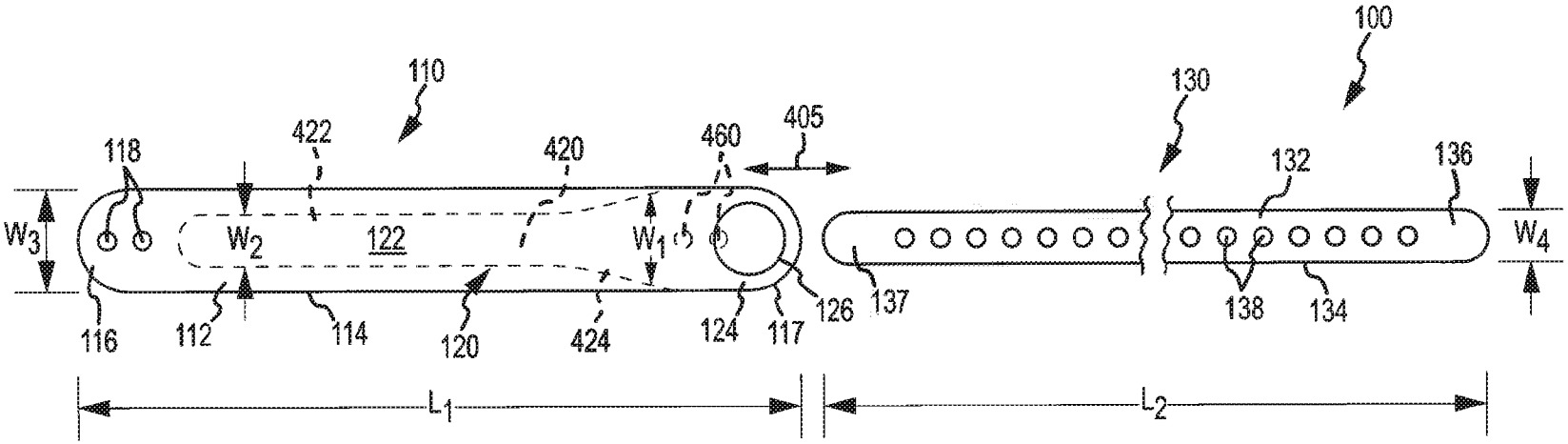
FIG. 4 illustrates an exploded view of the wearable band assembly of FIGS. 1 and 3 showing the base or identification band element (e.g., band piece with an RFID module or the like) and the sizing band element in a separated or spaced apart configuration (e.g., before assembly and sizing by a wearer)
Figure 5:
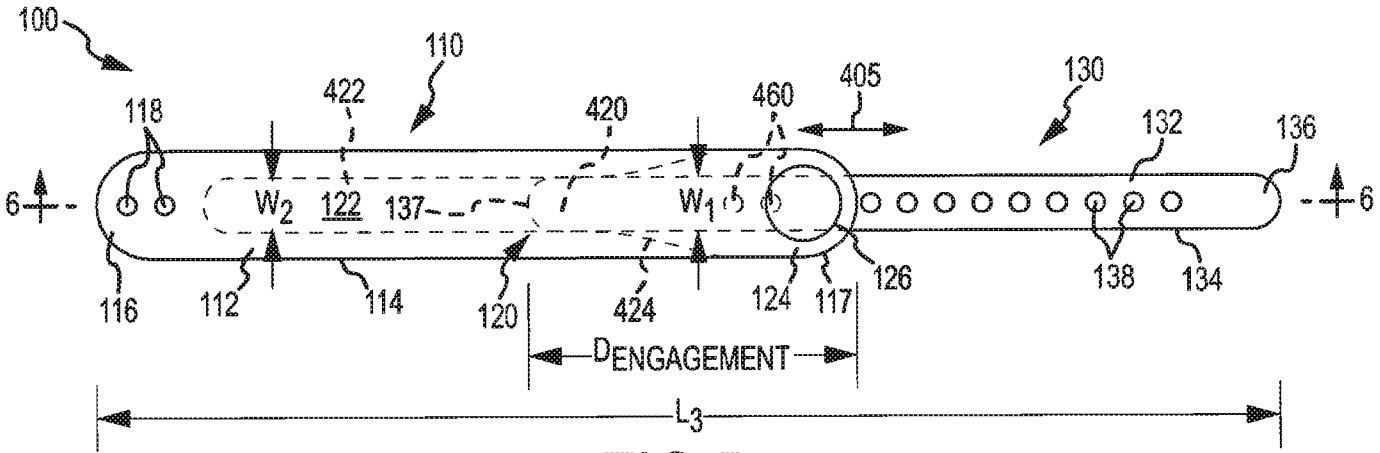
FIG. 5 illustrates the wearable band assembly of FIG. 4 with the sizing band element or extension slid into the recessed surface of the base band element body and with the two band pieces interconnected.

FIG. 4 illustrates an exploded view of the wearable band assembly 100 providing more detail of the base band element 110 and the sizing band element or extension 130 while FIG. 5 illustrates an assembled view of the wearable band assembly 100. The base band 110 has a body 112 that has a first length, $L_1$, that when combined with the length, $L_2$, of the sizing band element body 132 (or a portion extending outward from end 117) helps to define the overall length, $L_3$, of the band assembly 100. In this regard, the length, $L_1$, may be equal to the desired overall length, $L_3$, of the band assembly 100 at its shortest configuration, i.e., with only the base band element 110 used to provide the assembly 100 and extension 130 left decoupled as shown in FIG. 4. The body 112 may be an elongated strip with an outer shape defined by the outer wall/edge 114 with a body width, $W_3$, as measured from the two sides of the body 112 defined by the sidewall 114.

The body 112 includes a raised portion 120 that provides a receiving portion 122. The receiving portion 122 may include a recessed surface 420 on an opposite side of the body 112 (see FIG. 6) that has a width, $W_2$, defined by sidewalls 422 so as to allow the body 122 to receive the body 132 of the sizing band element 130. The recessed surface 420 may have a greater width, $W_1$, proximate to the end/head 124 or body end 117 so as to receive the end 116 when the body 112 is used as the entire assembly 100 (to suit a smaller range of wrist sizes). This wider recessed area 420 may be defined by sidewalls 424 that may extend out or taper toward the sidewall 114. The recessed surface 420 may include one, two, or more posts/studs 460 extending outward from body 112 so as to allow the body 112 to be selectively interconnected or coupled to the end 116 or to the body 132 via holes 138. At the end 117, the body 112 includes (or is attached to) the head 124, which may be merely a fashion item or may include "intelligence" in the form of a timepiece, an identification module (such as an RFID module, a bar code, or the like), or other component that provides one or more functions for the user. In some embodiments, the head 124 includes an embedded RFID transceiver that is programmed for the intended wearer of the band 110.

The sizing band element 130 has an elongated and typically planar body 132 extending a length, $L_2$, from end 136 to end 137. The body 132 is defined in part by sidewall 134, and holes 138 extend through the planar surfaces of the body 132. The holes 138 may extend nearly the entire length, $L_2$, to provide a large range or possibilities for sizing the assembly 100 (e.g., provide numerous engagement configurations to define a variety of overall lengths, $L_3$, of the assembly 100). The holes 138 are spaced apart and sized/shaped to match the spacing and size/shape of the prongs/posts 460 in body 112 to facilitate proper coupling of the elements 110, 130 together. The length, $L_2$, typically will exceed the depth or length of the receiving portion 122 (or recessed surface 420) such that at least the end 136 and its posts/prongs extend outward from the end 117 of the body 112 when the body 132 is positioned fully within the receiving portion 122 against recessed surface 420. The width, $W_4$, of the body 132 of the sizing band element 130 is less than the width, $W_3$, of the body 112 of the base band element 110 and generally is less than (or nearly equal to) the width, $W_2$, of the recessed surface 420 at its narrowest (e.g., raised surface 120 in the receiving portion 122).

A user may size the assembly 100 simply by sliding or moving 405 the two band elements 110, 130 relative to each other (or sliding the body 132 of the extension 130 within the receiving portion 122 or across recessed surface 420). Then, once properly sized, the body 132 may be pressed against the receiving surface 420 such that the posts or studs 460 engage a pair of the holes 138. FIG. 5 illustrates the wearable band assembly 100 in one configuration to provide a band of a particular size/length, $L_3$. In this arrangement, the band body 132 has been inserted into the receiving portion 122 a particular amount as shown as an engagement depth, $D_{Engagement}$, as measured from the tip/end 137 of the body 132 to the end 117 of the body 112 of the base band element 110 (e.g., where the body 132 begins to contribute to the overall assembly length, $L_3$). In practice, a user may adjust the length, $L_3$, by sliding 405 the extension 130 further into the receiving portion 122 to increase the engagement depth, $D_{Engagement}$ (but shorten the overall assembly length, $L_3$) or by sliding 405 the extension out of the receiving portion 122 to decrease the engagement depth, $D_{Engagement}$ (but increase the overall assembly length, $L_3$).

FIG. 6 illustrates a sectional view of the wearable band assembly 100 providing additional details of one embodiment. As shown, the body 132 of the slider extension band 130 is coupled or interconnected to the body 112 of the base band element 110. Specifically, a pair of posts or studs 460 are provided in the base band body 112 and extend outward from the recessed surface 420 (here, proximate to the end/head 117 to allow the assembly 100 to be lengthened to a greater amount than if positioned further toward end 116). The posts 460 have been pressed through a pair of holes 138 with heads or shoulders near the tips mating with a lower surface of the body 132, and, in this way, the two bodies 112, 132 are securely coupled together and the user has to apply a pulling or tensile force to the bands to pull them apart. Other techniques may be used to couple the body 132 to the body 112 such as a raised surface on the sides of posts 460 that could be received within a recessed surface in holes 138, which would allow the posts 460 to end flush with or recessed relative to the surface of the body 132 (e.g., to not extend outward toward a user's wrist/skin).

The body 132 of the extension 130 is shown to be planar and relatively thin with a thickness, $t_1$. The body 112 may have a similar thickness, $t_2$, in its non-raised portions while the raised portion 122 of the body 112 may have a greater thickness, $t_3$, to provide room for the recessed surface 420. The depth of the recessed surface 420 is defined by the height of sidewalls 422 and this may be equal to the thickness, $t_1$, of the extension body 132 such that the body 132 is fully received within the body 112 and may provide a flush or level mating surface when attached to a person's wrist. As with FIG. 5, the assembly 100 shown in FIG. 6 has the slider body 132 positioned with its end/tip 137 inserted into the receiving portion 122 a particular amount, $D_{Engagement}$, to define the overall length, $L_3$, of the assembly 100, and the user may move or slide the band body 132 (after disengaging the posts 460 from holes 138) to modify the size or length of the assembly 100.

The head 124 has a greater thickness, $t_4$, so as to allow it to contain a chamber 625 for receiving an ID technology component or device 690 as well as leaving room for the recessed surface 420. The ID technology device 690 may be an RFID chip or module that is overmolded by the material of the body 112, and the ID technology device 690 may be programmed or otherwise configured to store a set of data pertaining to a user or wearer of the assembly 100 (such as a user ID and other information such as access and/or rights information for a facility). As shown in FIG. 4, the recessed surface 420 below the head 124 may be wider (i.e., have a width, $W_1$, that is greater than the width, $W_2$) such that the end 116 of the body 112 may be received to allow the holes 118 to mate with prongs/posts 460 when the extension 130 is not included in assembly 100.

The design of the described band assembly (e.g., assembly 100) provides one common band that can be provided to a large population of users. This minimizes the number of products that have to be manufactured and limits the inventory required to service the population. For example, one or two (or more) base designs (e.g., colors, lengths, shapes, and so on) of the band assembly may be produced for the base band and/or the sizing band element. Then, the end user can size the assembly to their wrist and also (optionally) customize the band assembly by replacing one or both the bands 110, 130 with bands that may have art or graphic treatments desired by the end user. In some cases, the personalization or decorative element 126 is replaced while maintaining the base/core band element 110 with its intelligence component 690 (such as the RFID technology that may be programmed for the buyer/consumer), and the buyer/user may substitute a differing extension or slider 130 to personalize their assembly 100.

The above described invention including the preferred embodiment and the best mode of the invention known to the inventor at the time of filing is given by illustrative examples only. It will be readily appreciated that many deviations may be made from the specific embodiments disclosed in the specification without departing from the spirit and scope of the invention.

We claim:

1. An identification band, comprising:

a base band comprising an elongated body with a user identification member and with a recessed surface extending from an end of the body underneath the user identification member; and an extension band comprising an elongated body, wherein the extension band is coupled to the base band body with a first portion of the extension band body positioned within the recessed surface and a second portion of the extension band body extending outward from the end of the base band body to detachably couple with an opposite end of the body of the base band, wherein the first portion has a length selected from a plurality of discrete lengths, whereby an overall length of the identification band is adjustable by selective positioning of the first portion in the recessed surface.

2. The band of claim 1, wherein the user identification member comprises an RFID device.

3. The band of claim 1, wherein the extension band body has a length as measured from a first end to a second end, wherein the recessed surface extends a distance from the end of the base band body, and wherein the distance is at least about half the length of the extension band body.

4. The band of claim 3, wherein the recessed surface has a width defined by two spaced apart sidewalls that is at least about a width of the extension band body, wherein a post is provided on the recessed surface extending outward from the base band body, and wherein the extension band body includes a plurality of holes between the first and second ends configured for receiving the post to detachably couple the extension band body to the base band body.

5. The band of claim 4, wherein the extension band body is substantially planar and wherein the sidewalls have a height equal to at least about a thickness of the extension band body.

6. An identification band with a user adjustable length, comprising:

a base band comprising a body including an embedded user identification member comprising an RFID device storing user data, the base band body including a recessed surface extending from an end along a surface of the base band body; and an extension band comprising an elongated body, wherein the extension band is first detachably coupled to the base band body with a first portion of the extension band body positioned within the recessed surface and a second portion of the extension band body extending outward from the end of the base band body, wherein the extension band body has a length as measured from a first end to a second end, wherein the recessed surface extends a distance from the end of the base band body, wherein the distance is at least about half the length of the extension band body, and wherein the extension band body is second detachably coupled to the base band body via attachment of an end of the second portion distal to the base band body to a second end of the base band body.

7. The band of claim 6, wherein the recessed surface has a width defined by two spaced apart sidewalls that is at least about a width of the extension band body, wherein a post is provided on the recessed surface extending outward from the base band body, and wherein the extension band body includes a plurality of holes between the first and second ends configured for receiving the post to detachably couple the extension band body to the base band body.

8. The band of claim 6, wherein the band has a length defined by a combination of a length of the second portion of the extension band body and a length of the base band body.

9. The band of claim 7, wherein the extension band body is substantially planar and wherein the sidewalls have a height equal to at least about a thickness of the extension band body.

10. The band of claim 7, wherein the width of the recessed surface is substantially equal to the width of the extension band body and wherein the extension band body width is substantially uniform along the length of the extension band body.

* * * * *